US006315710B1

(12) United States Patent
Bushek et al.

(10) Patent No.: US 6,315,710 B1
(45) Date of Patent: Nov. 13, 2001

(54) HEARING SYSTEM WITH MIDDLE EAR TRANSDUCER MOUNT

(75) Inventors: Donald J. Bushek, Plymouth; Kai Kroll, Minnetonka; Scott C. Meyerson, Mounds View, all of MN (US)

(73) Assignee: St. Croix Medical, Inc., Minneapolis, MN (US)

( * ) Notice: Subject to any disclaimer, the term of this patent is extended or adjusted under 35 U.S.C. 154(b) by 0 days.

(21) Appl. No.: 08/897,851

(22) Filed: Jul. 21, 1997

(51) Int. Cl.[7] ..... H04R 25/00
(52) U.S. Cl. ..... 600/25; 387/68.3
(58) Field of Search ..... 600/25; 381/68.1–69; 607/136, 137, 55–56; 181/128–29

(56) References Cited

U.S. PATENT DOCUMENTS

| | | |
|---|---|---|
| 3,557,775 | 1/1971 | Mahoney . |
| 3,594,514 | 7/1971 | Wingrove . |
| 3,712,962 | 1/1973 | Epley . |
| 3,870,832 | 3/1975 | Fredrickson . |
| 3,882,285 | 5/1975 | Nunley et al. . |
| 3,931,648 | 1/1976 | Shea, Jr. . |
| 4,052,754 | 10/1977 | Homsy . |
| 4,169,292 | 10/1979 | Grote . |
| 4,466,690 | 8/1984 | Osypka . |
| 4,498,461 | 2/1985 | Hakansson . |
| 4,624,672 | 11/1986 | Lenkauskas . |

(List continued on next page.)

FOREIGN PATENT DOCUMENTS

| | | |
|---|---|---|
| 39 18 329 A1 | 12/1990 | (DE) . |
| 196 18 961 A1 | 11/1997 | (DE) . |
| 196 38 158 A1 | 4/1998 | (DE) . |
| 196 38 159 A1 | 4/1998 | (DE) . |

OTHER PUBLICATIONS

Maniglia, M.D., A.J., et al., "Contactless Semi–Implantable Electromagnetic Middle Ear Device for the Treatment of Sensorineural Hearing Loss: Short–Term and Long–Term Animal Experiments," Otolaryngologic Clinics of North America , 28:121–140 (1995).

Maniglia, M.D., A.J., "Implantable Hearing Devices: State of the Art," Otolaryngologic Clinics of North America , 28:175–200, (1989).

Maniglia, M.D., A.J., et al., "Electromagnetic Implantable Middle Ear Hearing Device of the Ossicular–Stimulating Type: Principles, Designs, and Experiments," Ann Otol. Rhinol Laryngol , 97 (Suppl 136 ), part 2, (1988).

(List continued on next page.)

*Primary Examiner*—John P. Lacyk
(74) *Attorney, Agent, or Firm*—Fredrikson & Byron, P.A.

(57) ABSTRACT

An improved partial middle ear implantable (P-MEI) or total middle ear implantable (T-MEI) hearing assistance system includes a device and method of providing between a vibrating auditory element and a transducer that senses or provides such mechanical vibrations adjustably positionable contact at a controllable, adjustable, or calibrated force. A screw adjusts a spacing between first and second members of the transducer mount to position the transducer and obtain the desired coupling force between the transducer and the auditory element. A spring provides an adjustable coupling force. A spacer limits further compression of the spring, providing additional force. A calibrated coupling force is obtained by compressing the spring by a known amount, such as by observing visual demarcations, or by reducing the spacing between the first and second members until the spacing is almost limited by the length of the spacer. Optimal ranges of forces for sensing malleus vibrations are disclosed.

35 Claims, 9 Drawing Sheets

U.S. PATENT DOCUMENTS

| | | | | |
|---|---|---|---|---|
| 4,628,907 | | 12/1986 | Epley . | |
| 4,696,287 | | 9/1987 | Hartmann et al. . | |
| 4,728,327 | | 3/1988 | Gersdorff . | |
| 4,729,366 | | 3/1988 | Schaefer . | |
| 4,756,312 | | 7/1988 | Epley . | |
| 4,850,962 | | 7/1989 | Schaefer . | |
| 4,957,478 | | 9/1990 | Maniglia . | |
| 4,969,900 | | 11/1990 | Fleisher . | |
| 5,015,224 | | 5/1991 | Maniglia . | |
| 5,085,628 | | 2/1992 | Engebretson et al. . | |
| 5,217,011 | | 6/1993 | Bisch . | |
| 5,277,694 | | 1/1994 | Leysieffer et al. . | |
| 5,411,467 | | 5/1995 | Hortmann et al. . | |
| 5,456,467 | | 10/1995 | Ball . | |
| 5,498,226 | | 3/1996 | Lenkauskas . | |
| 5,531,787 | | 7/1996 | Lesinski et al. . | |
| 5,554,096 | | 9/1996 | Ball . | |
| 5,558,618 | | 9/1996 | Maniglia . | |
| 5,624,376 | | 4/1997 | Ball et al. . | |
| 5,762,583 | * | 6/1998 | Adams et al. | 600/25 |
| 5,800,336 | | 9/1998 | Ball et al. . | |
| 5,836,863 | * | 11/1998 | Bushek et al. | 600/25 |
| 5,842,967 | * | 12/1998 | Kroll | 600/25 |

OTHER PUBLICATIONS

Ohno, T., et al., "Structure and Performance of the Main Components," Advances in Audiology (Karger, Basel), 4:52–72, (1988).

Snik, PhD., Ad F.M., et al., "The Bone–Anchored Hearing Aid Compared With Conventional Hearing Aids: Audiologic Results and the Patients' Opinions," Otolaryngologic Clinics of North America, 28:73–84, (1995).

Tjellström, M.D., PhD., A., "The Bone–Anchored Hearing Aid," Otolaryngologic Clinics of North America, 28:53–72, (1995).

Wilpizeski, PhD., C., et al., "A Simple Implantable Electromechanical Middle Ear," Transactions of the Pennsylvania Academy of Ophthalmology and Otolaryngology, 32:41–46, (1979).

Yanagihara, N., et al., "Implantable Hearing Aid," Archives of Otolaryngology Head and Neck Surgery , 113: 869–872, (1987).

Riggs, M.T., "Powered Incus Replacement Prosthesis (SBIR Grant Application)," Letter, (1983).

Maniglia, M.D., A.J., "A Contactless Electromagnetic Implantable Middle Ear Device for Sensorineural Hearing Loss," Ear, Nose and Throat Journal , 73(2), (1994).

Gyo, M.D., K., et al., "Present Status and Outlook of the Implantable Hearing Aid," American Journal of Otologyl , 11:250–253.

* cited by examiner

HEARING SYSTEM WITH MIDDLE EAR TRANSDUCER MOUNT

THE FIELD OF THE INVENTION

This invention relates generally to at least partially implantable hearing assistance systems, and more particularly, but not by way of limitation, to disposing sensing or stimulation transducers in the middle ear for contacting auditory elements.

BACKGROUND

Some types of partial middle ear implantable (P-MEI), total middle ear implantable (T-MEI), cochlear implant, or other hearing assistance systems utilize components disposed within the middle ear or inner ear regions. Such components may include an input transducer for receiving sound vibrations or an output stimulator for providing mechanical or electrical output stimuli based on the received sound vibrations.

An example of one such device is disclosed in U.S. Pat. No. 4,729,366, issued to D. W. Schaefer on Mar. 8, 1988. In the '366 patent, a mechanical-to-electrical piezoelectric input transducer is associated with a malleus bone in the patient's middle ear. The malleus vibrates in response to sounds received at the patient's tympanic membrane (eardrum). The piezoelectric input transducer transduces a mechanical energy of the malleus vibrations into an electrical signal, which is amplified and further processed by an electronics unit. A resulting electrical signal is provided to an electrical-to-mechanical piezoelectric output transducer that generates a mechanical vibration that is coupled to a stapes bone in the ossicular chain or to an oval window or round window of a cochlea. In the '366 patent, the ossicular chain is interrupted by removal of an incus bone. Removal of the incus prevents the mechanical vibrations delivered by the piezoelectric output transducer from mechanically feeding back to the piezoelectric input transducer.

Piezoelectric transducers are one example of a class of electromechanical transducers that require contact to sense or provide mechanical vibrations. For example, the piezoelectric input transducer in the '366 patent contacts the malleus for detecting mechanical vibrations. In another example, the piezoelectric output transducer in the '366 patent contacts a stapes bone or the oval or round window of the cochlea.

Proper positioning of the transducer and good contact between the transducer and the malleus is essential to properly transducing the received mechanical vibrations into a resulting electrical signal for hearing assistance processing. For example, there is a need in the art to ascertain whether too much force between the transducer and the malleus can mechanically load the vibrating malleus and attenuate the desired mechanical vibration signal or alter its frequency characteristics. It may be likely that, in an extreme case, too much force can damage or break either the malleus or the transducer. It may also be likely that too little force between the transducer and the malleus may be insufficient to detect the mechanical vibration signal, and is more likely to result in a complete loss of signal detection if the transducer and the malleus become dissociated.

Good contact between the transducer and the stapes is also critical for assisting hearing by providing mechanical stimulation. For example, there is a need in the art to ascertain whether too much force between the stimulating transducer and the stapes can attenuate the mechanical vibration signal provided by the transducer or alter its frequency characteristics. It may be likely that, in an extreme case, too much force can damage or break either the stapes or the transducer. It may also be likely that too little force between the stimulating transducer and the stapes may be insufficient to vibrate the stapes, and is more likely to result in a complete loss of assisted mechanical vibrations if the stimulating transducer and the stapes become dissociated. There is a need in the art to better control contact between the transducer and an auditory element such as the malleus or the stapes.

For the reasons stated above, and for other reasons stated below which will become apparent to those skilled in the art upon reading and understanding the present specification, there is a need in the art for improved transducer positioning and contact to an auditory element while sensing and providing middle ear sound vibrations.

SUMMARY

The present invention provides an improved hearing assistance system that obtains more precise positioning and contact between a vibrating auditory element and a transducer that senses or provides such mechanical vibrations, such as by providing a controllable, adjustable, or calibrated force.

In one embodiment, the present invention provides an apparatus that includes a first member, proportioned for disposition in a middle ear. A second member, proportioned for disposition in the middle ear, threadably engages the first member. A transducer, proportioned for disposition in the middle ear, is attached to the second member. This embodiment allows accurate and reliable positioning of a transducer for contact with an auditory element.

In another embodiment, the present invention includes a transducer mount that includes movably engaged first and second members, and an elastically deformable coupler couplable to each of the first and second members. This embodiment is capable of providing a controllable, adjustable, or calibrated force between the transducer and the auditory element.

In another embodiment, the first member includes a mounting portion and an engaging portion extending from the mounting portion. The engaging portion includes a guide. The second member slidably engages the first member. A spring couples the first and second members. One end of the spring is mechanically couplable to the first member and the other end of the spring is mechanically couplable to the second member. A first stop, which is attached to the first member, abuts one end of the spring. A second stop is attached to the second member.

According to one aspect of the invention, the first and second members are proportioned for disposition within a middle ear and the first stop engages the guide. The first stop is adjustably attached to the first member. A third member is coupled to the first member and threadably coupled to the first stop for providing an adjustable spacing therebetween. A spacer is mechanically couplable to one of the first and second stops, such that a spatial relationship between the first and second stops is limited by the spacer engaging the other of the first and second stops. The spring provides between the transducer and the auditory element a force that varies in response to the adjustable spacing between the first stop and the first member.

Another aspect of the present invention provides a method of coupling a transducer to an auditory element. A transducer mount is disposed in a middle ear. The transducer mount includes a first member and also includes a second member carrying a transducer. The first member includes a threaded member that is threadably engaged with the second member. The transducer is coupled to the auditory element by turning the threaded member to adjust a spatial relationship between the first and second members.

In another embodiment, a method of coupling a transducer to an auditory element includes disposing a transducer mount in a middle ear. The transducer mount includes a first member and also includes a second member carrying a transducer and movably engaged with the first member by an elastically deformable coupler. The transducer is coupled to an auditory element. A spatial relationship between the first and second members is adjusted to provide a desired coupling force between the transducer and the auditory element. In one embodiment, the desired coupling force between the transducer and the auditory element is obtained by compressing the elastically deformable coupler. In another embodiment, the desired coupling force is obtained by engaging the first and second members with a spacer to limit a spatial relationship between the first and second members, such as for limiting the compression of the elastically deformable coupler.

In another embodiment, the present invention provides a method of sensing mechanical vibrations of a malleus. A piezoelectric transducer is disposed in the middle ear. A portion of the transducer is positioned to contact the malleus. A force between the transducer and the malleus is adjusted to be approximately between 0 milli-Newtons and 75 milli-Newtons, or approximately between 0 milli-Newtons and 50 milli-Newtons, or approximately between 20 milli-Newtons and 50 milli-Newtons.

Thus, the present invention provides an improved hearing assistance system that provides more precise positioning and contact between a vibrating auditory element and a transducer that senses or provides such mechanical vibrations. According to one aspect of the present invention, adjustably positionable contact between a transducer and a corresponding auditory element is at a controllable, adjustable, or calibrated force. Adjusting a spatial relationship between first and second members of the transducer mount obtains the desired transducer positioning and the desired coupling force between the transducer and the auditory element.

BRIEF DESCRIPTION OF THE DRAWINGS

In the drawings, like numerals describe substantially similar components throughout the several views.

DETAILED DESCRIPTION

In the following detailed description, reference is made to the accompanying drawings which form a part hereof, and in which is shown, by way of illustration, specific embodiments in which the invention may be practiced. These embodiments are described in sufficient detail to enable those skilled in the art to practice the invention, and it is to be understood that the embodiments may be combined, or that other embodiments may be utilized and that structural, logical and electrical changes may be made without departing from the scope of the present invention. The following detailed description is, therefore, not to be taken in a limiting sense, and the scope of the present invention is defined by the appended claims and their equivalents. In the accompanying drawings, like numerals describe substantially similar components throughout the several views.

The present invention provides a hearing assistance system, transducer mount device, and hearing assistance methods of use, such as for sensing or providing mechanical vibrations to or from an auditory element. The auditory element is defined to include, but is not limited to, a tympanic membrane, a malleus bone, an incus bone, a stapes bone, a cochlea, an oval window of the cochlea, a round window of the cochlea, or other components of hearing in a living organism, whether anatomically inherent in the living organism or prosthetic. According to one aspect of the invention, the transducer mount provides proper transducer positioning and contact between a transducer and an auditory element at a controllable, adjustable, or calibrated force, as described below. The invention is capable of use as or with a middle ear implantable hearing system such as a partial middle ear implantable (P-MEI), total middle ear implantable (T-MEI), cochlear implant, or other hearing system. A P-MEI or T-MEI hearing system assists the human auditory system in converting acoustic energy contained within sound waves into electrochemical signals delivered to the brain and interpreted as sound.

Figure 1:
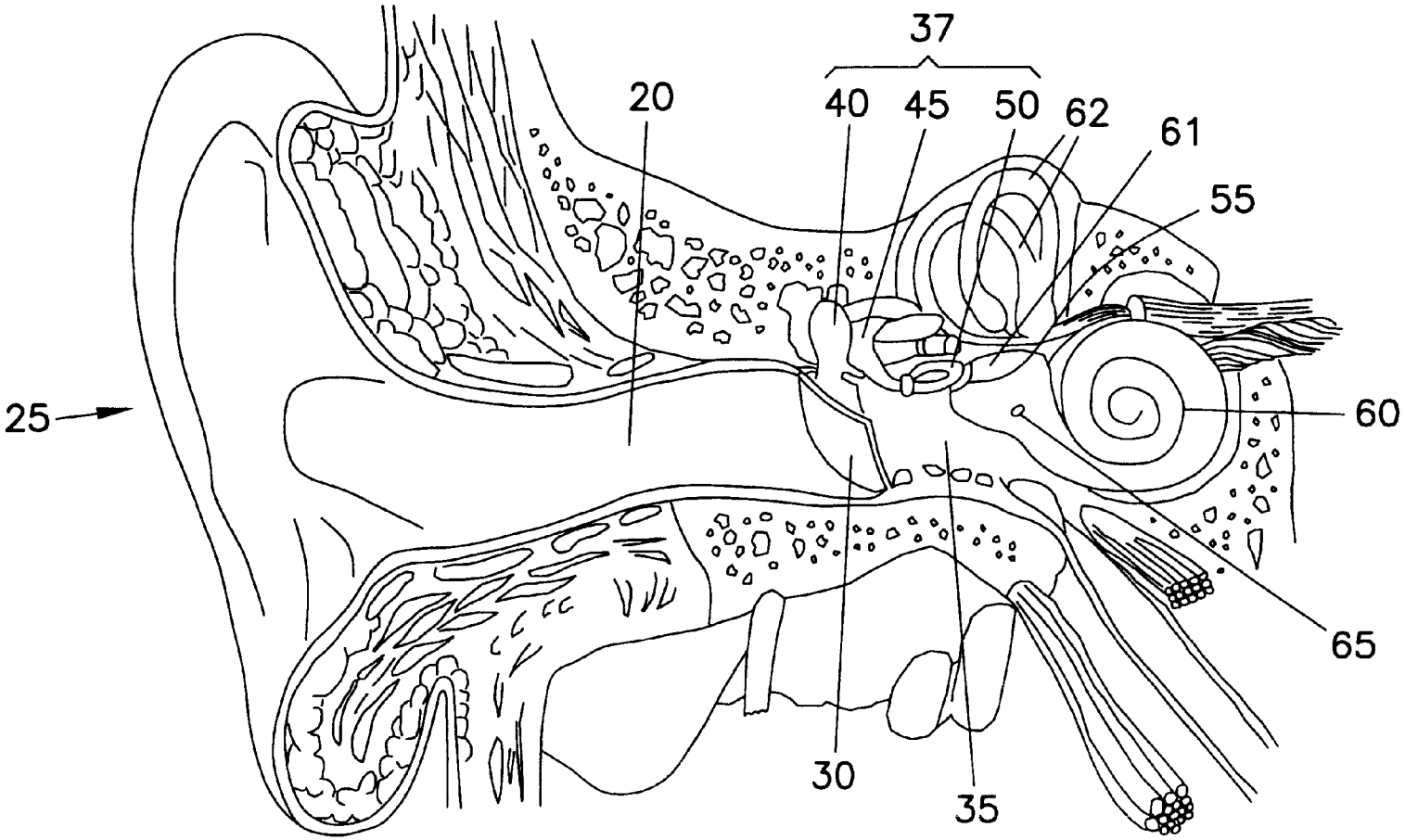
FIG. 1 is a schematic diagram that illustrates generally a frontal section of an anatomically normal human right ear in which the present invention operates.

FIG. 1 illustrates generally a human auditory system. Sound waves are directed into an external auditory canal 20 by an outer ear (pinna) 25. The frequency characteristics of the sound waves are slightly modified by the resonant characteristics of the external auditory canal 20. These sound waves impinge upon the eardrum (tympanic membrane) 30, interposed at the terminus of the external auditory canal 20, between it and the tympanic cavity (middle ear) 35. Variations in the sound waves produce tympanic vibrations. The mechanical energy of the tympanic vibrations is communicated to the inner ear (which comprises cochlea 60, vestibule 61, and semicircular canals 62) by a sequence of articulating bones located in the middle ear 35. This sequence of articulating bones is referred to generally as the ossicular chain 37. Thus, the tympanic membrane 30 and ossicular chain 37 transform acoustic energy in the external auditory canal 20 to mechanical energy at the cochlea 60.

The ossicular chain 37 includes three ossicles: a malleus 40, an incus 45, and a stapes 50. The malleus 40 includes manubrium and head portions. The manubrium of the malleus 40 attaches to the tympanic membrane 30. The head of the malleus 40 articulates with one end of the incus 45. The incus 45 normally couples mechanical energy from the vibrating malleus 40 to the stapes 50. The stapes 50 includes a capitulum portion, comprising a head and a neck, connected to a footplate portion by means of a support crus comprising two crura. The stapes 50 is disposed in and against a membrane-covered opening on the cochlea 60. This membrane-covered opening between the cochlea 60 and middle ear 35 is referred to as the oval window 55. Oval window 55 is considered part of cochlea 60 in this patent application. The incus 45 articulates the capitulum of the stapes 50 to complete the mechanical transmission path.

Normally, prior to implantation of the invention, tympanic vibrations are mechanically conducted through the malleus 40, incus 45, and stapes 50, to the oval window 55. Vibrations at the oval window 55 are conducted into the fluid-filled cochlea 60. These mechanical vibrations generate fluidic motion, thereby transmitting hydraulic energy within the cochlea 60. Pressures generated in the cochlea 60 by fluidic motion are accommodated by a second membrane-covered opening on the cochlea 60. This second membrane-covered opening between the cochlea 60 and middle ear 35 is referred to as the round window 65. Round window 65 is considered part of cochlea 60 in this patent application. Receptor cells in the cochlea 60 translate the fluidic motion into neural impulses which are transmitted to the brain and perceived as sound. However, various disorders of the tympanic membrane 30, ossicular chain 37, and/or cochlea 60 can disrupt or impair normal hearing.

Hearing loss due to damage in the cochlea 60 is referred to as sensorineural hearing loss. Hearing loss due to an inability to conduct mechanical vibrations through the middle ear 35 is referred to as conductive hearing loss. Some patients have an ossicular chain 37 lacking sufficient resiliency to transmit mechanical vibrations between the tympanic membrane 30 and the oval window 55. As a result, fluidic motion in the cochlea 60 is attenuated. Thus, receptor cells in the cochlea 60 do not receive adequate mechanical stimulation. Damaged elements of ossicular chain 37 may also interrupt transmission of mechanical vibrations between the tympanic membrane 30 and the oval window 55.

Various techniques have been developed to remedy hearing loss resulting from conductive or sensorineural hearing disorder. For example, tympanoplasty is used to surgically reconstruct the tympanic membrane 30 and establish ossicular continuity from the tympanic membrane 30 to the oval window 55. Various passive mechanical prostheses and implantation techniques have been developed in connection with reconstructive surgery of the middle ear 35 for patients with damaged elements of ossicular chain 37. Two basic forms of prosthesis are available: total ossicular replacement prostheses (TORP), which is connected between the tympanic membrane 30 and the oval window 55; and partial ossicular replacement prostheses (PORP), which is positioned between the tympanic membrane 30 and the stapes 50.

Various types of hearing aids have been developed to compensate for hearing disorders. A conventional "air conduction" hearing aid is sometimes used to overcome hearing loss due to sensorineural cochlear damage or mild conductive impediments to the ossicular chain 37. Conventional hearing aids utilize a microphone, which transduces sound into an electrical signal. Amplification circuitry amplifies the electrical signal. A speaker transduces the amplified electrical signal into acoustic energy transmitted to the tympanic membrane 30. However, some of the transmitted acoustic energy is typically detected by the microphone, resulting in a feedback signal which degrades sound quality. Conventional hearing aids also often suffer from a significant amount of signal distortion.

Implantable hearing systems have also been developed, utilizing various approaches to compensate for hearing disorders. For example, cochlear implant techniques implement an inner ear hearing system. Cochlear implants electrically stimulate auditory nerve fibers within the cochlea 60. A typical cochlear implant system includes an external microphone, an external signal processor, and an external transmitter, as well as an implanted receiver and an implanted single channel or multichannel probe. A single channel probe has one electrode. A multichannel probe has an array of several electrodes. In the more advanced multichannel cochlear implant, a signal processor converts speech signals transduced by the microphone into a series of sequential electrical pulses corresponding to different frequency bands within a speech frequency spectrum. Electrical pulses corresponding to low frequency sounds are delivered to electrodes that are more apical in the cochlea 60. Electrical pulses corresponding to high frequency sounds are delivered to electrodes that are more basal in the cochlea 60. The nerve fibers stimulated by the electrodes of the cochlear implant probe transmit neural impulses to the brain, where these neural impulses are interpreted as sound.

Other inner ear hearing systems have been developed to aid patients without an intact tympanic membrane 30, upon which "air conduction" hearing aids depend. For example, temporal bone conduction hearing systems produce mechanical vibrations that are coupled to the cochlea 60 via a temporal bone in the skull. In such temporal bone conduction hearing systems, a vibrating element can be implemented percutaneously or subcutaneously.

A particularly interesting class of hearing systems includes those which are configured for disposition principally within the middle ear 35 space. In middle ear implantable (MEI) hearing assistance systems, an electrical-to-mechanical output transducer couples mechanical vibrations to the ossicular chain 37, which is optionally interrupted to allow coupling of the mechanical vibrations thereto. Both electromagnetic and piezoelectric output transducers have been used to effect the mechanical vibrations upon the ossicular chain 37.

One example of a partial middle ear implantable (P-MEI) hearing system having an electromagnetic output transducer comprises: an external microphone transducing sound into electrical signals; external amplification and modulation circuitry; and an external radio frequency (RF) transmitter for transdermal RF communication of an electrical signal. An implanted receiver detects and rectifies the transmitted signal, driving an implanted coil in constant current mode. A resulting magnetic field from the implanted drive coil vibrates an implanted magnet that is permanently affixed only to the incus 45. Such electromagnetic output transducers have relatively high power consumption requiring larger batteries, which limits their usefulness in total middle ear implantable (T-MEI) hearing systems.

A piezoelectric output transducer is also capable of effecting mechanical vibrations to the ossicular chain 37. An example of such a device is disclosed in U.S. Pat. No. 4,729,366, issued to D. W. Schaefer on Mar. 8, 1988. In the '366 patent, a mechanical-to-electrical piezoelectric input transducer is associated with the malleus 40, transducing mechanical energy into an electrical signal, which is amplified and further processed by an electronics unit. A resulting electrical signal is provided to an electrical-to-mechanical piezoelectric output transducer that generates a mechanical vibration coupled to an element of the ossicular chain 37 or to the oval window 55 or round window 65. In the '366 patent, the ossicular chain 37 is interrupted by removal of the incus 45. Removal of the incus 45 prevents the mechanical vibrations delivered by the piezoelectric output transducer from mechanically feeding back to the piezoelectric input transducer. As described above, piezoelectric and certain other transducers typically require contact with an auditory element for sensing or providing mechanical vibrations. As described below, the present invention provides a device and method of providing more precise positioning and contact between a vibrating auditory element and a transducer that senses or provides such mechanical vibrations. The present invention is also useful for providing more precise positioning and contact between any implantable hearing aid component and a corresponding auditory element, or between implantable hearing aid components.

Figure 2:
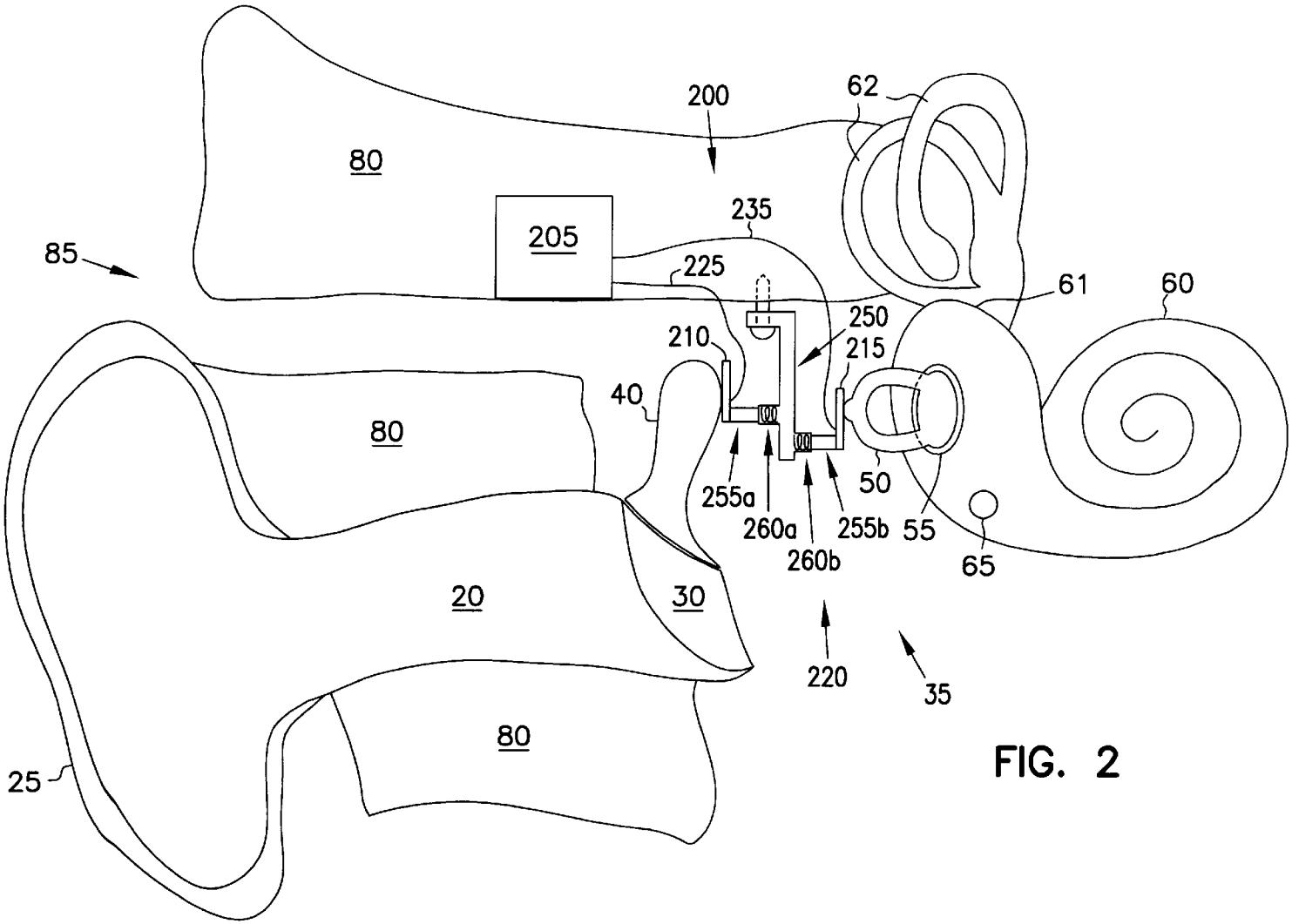
FIG. 2 is a schematic/block diagram illustrating generally one embodiment of a hearing assistance system, including a transducer mount according to one aspect of the present invention.

FIG. 2 is a schematic/block diagram illustrating generally, by way of example, one embodiment of a hearing assistance system according to one aspect of the present invention. This embodiment includes hearing assistance device 200, which is implanted in the middle ear 35, and portions of which are optionally implanted in the mastoid 80 portion of the temporal bone. For example, a mastoidectomy may be performed on a human or other patient. An opening 85 is formed in mastoid 80 to provide access to middle ear 35 for implanting a portion or portions of hearing assistance device 200. In this embodiment, incus 45 is removed to prevent mechanical feedback through the ossicular chain 37, as described above. However, such removal of incus 45 is not required to practice the invention. Hearing assistance device 200 includes electronics unit 205, an input sensor 210, and an output stimulator 215. A transducer mount 220 is provided, such as for mounting portions of input sensor 210 and output stimulator 215 within middle ear 35. Though the embodiment of FIG. 2 provides a unitary transducer mount 220, other embodiments of the invention provide separate transducer mounts 220 for each of input sensor 210 and output stimulator 215, as described below.

Input sensor 210 senses the mechanical sound vibrations of an auditory element, and provides a resulting electrical input signal in response thereto. In the embodiment of FIG. 2, malleus 40 is illustrated, by way of example, as the auditory element from which vibrations are sensed, but other auditory elements could also be used for sensing mechanical sound vibrations, including, but not limited to tympanic membrane 30, incus 45 or other ossicle, or any prosthetic auditory element serving a similar function. Input sensor 210 provides the resulting electrical input signal, such as through one or more lead wires at node 225, to electronics unit 205. Electronics unit 205 receives the input signal, performs amplification, filtering, or other signal processing of the input signal, and provides a resulting electrical output signal, such as through one or more lead wires, illustrated generally by node 235, to output stimulator 215. Output stimulator 215 directly or indirectly provides mechanical or electrical stimulation of the inner ear. In the embodiment of FIG. 2, for example, output stimulator 215 transmits mechanical vibrations to oval window 55 of cochlea 60 through stapes 50.

Transducer mount 220 includes a first member 250 and at least one second member 255*a*, 255*b* (referred to generally as 255) that movably engages the first member 250. An elastically deformable coupler 260*a–b* (referred to generally as 260) couples first member 250 and at least one second member 255. Second member 255*a* carries input sensor 210, such as an electromechanical transducer for transducing mechanical vibrations received from an auditory element (e.g., malleus 40) into an electrical input signal provided through an input lead at node 225 to electronics unit 205. Second member 255*b* carries output stimulator 215, such as an electromechanical transducer for transducing an electrical output signal received through an output lead at node 235 from electronics unit 205 into a mechanical vibration provided to an auditory element (e.g., stapes 50).

According to one method of practicing the present invention, transducer mount 220 is disposed in middle ear 35, such as by mastoidectomy and insertion through opening 85. Transducer mount 220 is secured in middle ear 35, such as by adhesive or mechanical fixation to mastoid 80 in middle ear 35. In one embodiment, for example, transducer mount 220 is secured by a self-tapping bone screw. Transducer mount 220 includes first member 250 and second member 255. Second member 255 carries a transducer such as input sensor 210, and is movably engaged with first member 250 by an elastically deformable coupler 260. In one embodiment, for example, elastically deformable coupler 260 includes a spring. The transducer is coupled to an auditory element, such as malleus 40. A spatial relationship between first and second members 250 and 255, respectively, is adjusted to provide proper positioning of the transducer and a desired coupling force between the transducer and the auditory element. Thus, according to one aspect of the invention, transducer mount 220 provides adjustably positionable contact between at least one transducer and a corresponding auditory element at a controllable, adjustable, or calibrated force, as described below.

Figures 3, 4:
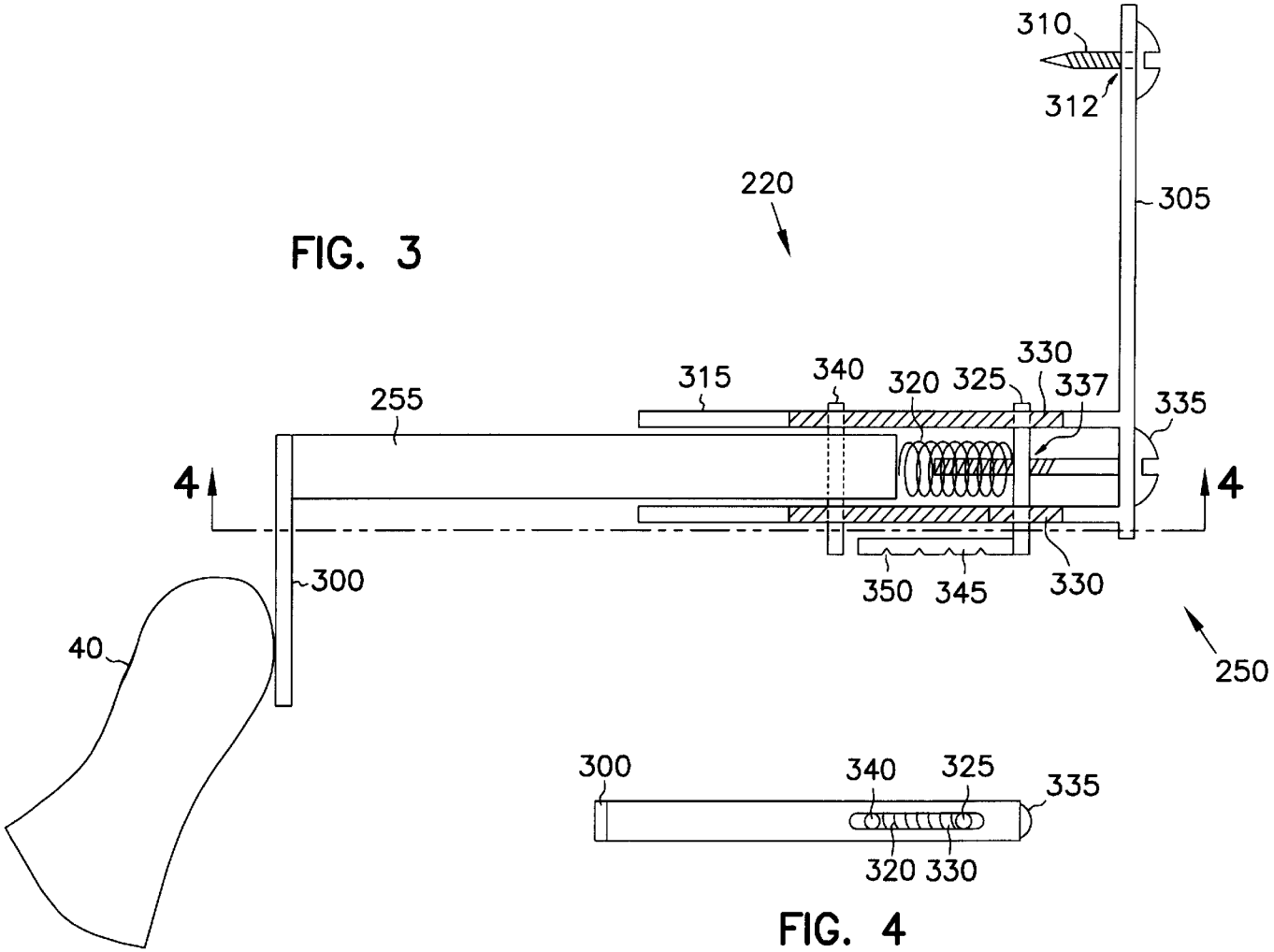
FIG. 3 is a schematic diagram illustrating generally a cutaway view of another embodiment of the transducer mount according to another aspect of the present invention.
FIG. 4 illustrates generally a side view taken along the cutline 4—4 in FIG. 3.

FIG. 3 is a schematic diagram illustrating generally by way of example, but not by way of limitation, a cutaway view of another embodiment of transducer mount 220 according to one aspect of the present invention. In FIG. 3, transducer mount 220 provides contact between a single electromechanical transducer, such as bi-element (sometimes referred to as a bimorph) piezoelectric transducer 300, and a corresponding auditory element. However, other types of electromechanical transducers requiring contact with a vibrating auditory element could also be used including, but not limited to: a ceramic piezoelectric transducer, a polarized fluoropolymer film piezoelectric transducer such as polyvinylidene fluoride (PVDF), a single element piezoelectric transducer, etc. In one vibration-sensing embodiment, such as illustrated in FIG. 3, transducer 300 functions as input sensor 210 of FIG. 2. In one vibration-providing embodiment, transducer 300 functions as output stimulator 215 of FIG. 2.

In the embodiment of FIG. 3, first member 250 includes a mounting portion 305 for securing transducer mount 220. For example, in one embodiment, mounting portion 305 is appropriately proportioned to be secured by an adhesive (e.g., cyanoacrylate) to a mastoid 80 within middle ear 35 or any other suitable location. In another embodiment, mounting portion 305 is appropriately proportioned to be secured by a fastener, such as a captured bone screw 310 extending through an opening 312 in mounting portion 305 of first member 250, and capable of being secured to a mastoid 80 within middle ear 35 or any other suitable location. First member 250 also includes an engaging portion, such as barrel 315, extending from mounting portion 305. Barrel 315 is illustrated as extending approximately perpendicular to mounting portion 305, but could also otherwise fixedly or adjustably extend from mounting portion 305 such as, for example, a longitudinal extension, an angled extension, a pivotable extension, or a locking hinged extension from mounting portion 305. Barrel 315 receives second member 255, as described below.

According to one aspect of the invention, for example, one of first member 250 and second member 255 is coaxially hollowed for receiving the other of first member 250 and second member 255. In the embodiment of FIG. 3, first member 250 includes coaxially hollowed barrel 315 for receiving a proximal end of second member 255 in the coaxially hollowed portion of barrel 315. In this embodiment, transducer 300 extends from a distal end of second member 255 for contacting the auditory element (e.g., malleus 40). Alternatively, a coaxially hollowed portion of second member 255 receives a portion of first member 250. In yet another embodiment, first member 250 and second member 255 are adjacently, rather than coaxially, intercoupled, or otherwise intercoupled such that second member 255 slidably or movably engages a portion of first member 250.

The embodiment of FIG. 3 includes an elastically deformable coupler 260, such as spring 320 being directly or indirectly couplable to first member 250 and second member 255, as described below. Elastically deformable coupler 260 can also include one or more elements, other than spring 320, for providing a compressive force including, but not limited to: a coil spring, a beam spring, an elastomeric (e.g., silicone) column, a telescoping or other pneumatic cylinder, a telescoping or other hydraulic cylinder, or any other suitable technique of providing a force. A first stop 325 is fixedly or adjustably attached to first member 250. For example, as illustrated in FIG. 3, first stop 325 is movably attached to first member 250 by engaging a guide 330 in barrel 315 portion of first member 250. Guide 330 is illustrated as hatched portions of barrel 315 in FIG. 3, which represents one embodiment in which guide 330 includes slots on opposing sides of hollowed cylindrical barrel 315. One example of such a slotted guide 330 is illustrated in FIG. 4, which illustrates generally a side view taken along the cutline 4—4 in FIG. 3. In the embodiment of FIG. 3, first stop 325 at least partially extends through each slot of guide 330. However, in another embodiment, guide 330 is implemented as a single slot through which first stop 325 at least partially extends. Guide 330 can also be implemented as any other slidably mating features in barrel 315 and first stop 325 allowing movement of first stop 325 with respect to first member 250, such as in the direction that barrel 315 extends from mounting portion 305. Moreover, by engaging first stop 325 with guide 330, rotation between first stop 325 and barrel 330 is advantageously inhibited.

Spring 320 has two ends. One end of spring 320 is capable of being directly or indirectly mechanically coupled to first member 250, such as by abutting first stop 325, which is coupled to first member 250 (by engaging guide 330 within cylindrically hollowed barrel 315, or otherwise). The other end of spring 320 is capable of being directly or indirectly mechanically coupled to second member 255, such as by abutting an end portion of second member 255 that is received (e.g., coaxially) within hollowed barrel 315. Spring 320 provides between first member 250 and second member 255 a force that is transmitted to transducer 300 and the auditory element (e.g., malleus 40) which transducer 300 contacts. Over at least a portion of its compressible range, the force provided by spring 320 is proportional to the degree of compression of spring 320. In one embodiment, spring 320 is formed of a biocompatible metal or plastic (e.g., stainless steel or silicone) and has a spring constant that provides a compressive force per unit length of approximately 250 milli-Newtons per millimeter.

First stop 325 is adjustably coupled to first member 250, such as by a third member. In one embodiment, the third member includes a threaded member such as a captured screw 335 having threads that engage a threaded opening 337 in first stop 325. By turning screw 335, first stop 325 moves along guide 330, toward or away from mounting portion 305 of first member 250. As first stop 325 moves away from mounting portion 305 of first member 250, the distance between first stop 325 and second member 255 is decreased until opposite ends of spring 320 are mechanically coupled to first stop 325 and second member 255, respectively. By further turning screw 335, second member 255 moves together with first stop 325 and spring 320 until transducer 300 contacts an auditory element (e.g., malleus 40) or other substantially fixed object, after which spring 320 begins to compress. As spring 320 is compressed, the force between transducer 300 and the auditory element contacted by transducer 300 increases proportionately to the compression of spring 320. As a result, transducer mount 220 provides adjustably positionable contact between transducer 300 and the corresponding auditory element at a controllably adjustable force.

According to another aspect of the embodiment of FIG. 3, transducer mount 220 optionally includes an additional feature of second stop 340 that is directly or indirectly engaged or attached to second member 255. Second stop 340 is mechanically coupled to spring 320 through second member 255. In one embodiment, second stop 340 engages guide 330, or a separate similarly formed guide, in a manner similar to that of first stop 325 (i.e., second stop 340 extends at least partially into one or more opposing slots of guide 330 in barrel 315). As a result, second member 255 is captured at least partially within barrel 315, unless second stop 340 is disengaged from the slots of guide 330. Thus, in one embodiment of the present invention, second stop 340 also advantageously prevents dissociation of second member 255 from barrel 315 portion of first member 250. Moreover, by engaging second stop 340 with guide 330, rotation of second stop 340 and second member 255 with respect to barrel 315 is advantageously inhibited.

According to another aspect of the embodiment of FIG. 3, transducer mount 220 optionally includes an additional feature of a spacer 345 that is directly or indirectly coupled to one of first stop 325 and second stop 340 for limiting a spatial relationship between first stop 325 and second stop 340 by engaging the other of first stop 325 and second stop 340. In FIG. 3, for example, spacer 345 is attached to first stop 325.

In one method of using the feature of spacer 345, transducer 300 is brought into contact with an auditory element, such as by turning screw 335, or otherwise. When transducer 300 contacts an auditory element and screw 335 is turned, spring 320 compresses as first stop 325 and spacer 345 move together toward second stop 340 along guide 330. As spring 320 compresses, the force transmitted to the auditory element increases. As screw 335 is further turned, spacer 345 eventually engages second stop 340, limiting any further decrease in the spacing between first stop 325 and second stop 340. This also limits further compression of spring 320, such that the force between transducer 300 and the auditory element it contacts thereafter becomes independent of the degree of compression of spring 320. As screw 335 is further turned with spacer 345 engaging second stop 340, the force between transducer 300 and the auditory element it contacts increases independently of the degree of compression of spring 320. When engaged with second stop 340, spacer 345 advantageously prevents overcompression of spring 320 and allows the implanting physician to apply a greater amount of force than is available from spring 320.

In one embodiment a calibrated force between transducer 300 and the auditory element that transducer 300 contacts is obtained by turning screw 335 until just before spacer 345 engages second stop 340. When screw 335 is so adjusted, the length of spacer 345 provides a predetermined calibrated compression of spring 320 that provides the desired calibrated force between transducer 300 and the auditory element that transducer 300 contacts. Thus, by selecting the length of spacer 345, a calibrated force is obtained.

In one embodiment, selecting the length of spacer 345 is performed during manufacturing of transducer mount 220. For example, different ones of transducer mount 220 can be manufactured with differing lengths of spacer 345 such that the implanting physician can select the appropriate transducer mount 220 having a particular spacer 345 length for obtaining the desired calibrated force.

In another embodiment, the length of spacer 345 selected by the user, such as by providing a spacer 345 having a length that is alterable by the user, either prior to or during the implantation procedure. In one embodiment, for example, spacer 345 is scored with depressions 350, notches, or similar features that are located at calibrated intervals on spacer 345 to provide severability and removal of predetermined portions of spacer 345. As a result, the length of spacer 345 can be adjusted by a known amount by breaking away portions of spacer 345 between depressions 350, such as by using a forceps or similar tool.

Depressions 350 provide a convenient technique for breaking away portions of spacer 345. In another embodiment, depressions 350 are replaced by trimming demarcations that are similarly located at calibrated intervals on spacer 345. Such trimming demarcations provide a visual aid to the user for cutting away portions of spacer 345, thereby reducing the length of spacer 345 by a known amount for obtaining the desired calibrated force.

Figure 5:
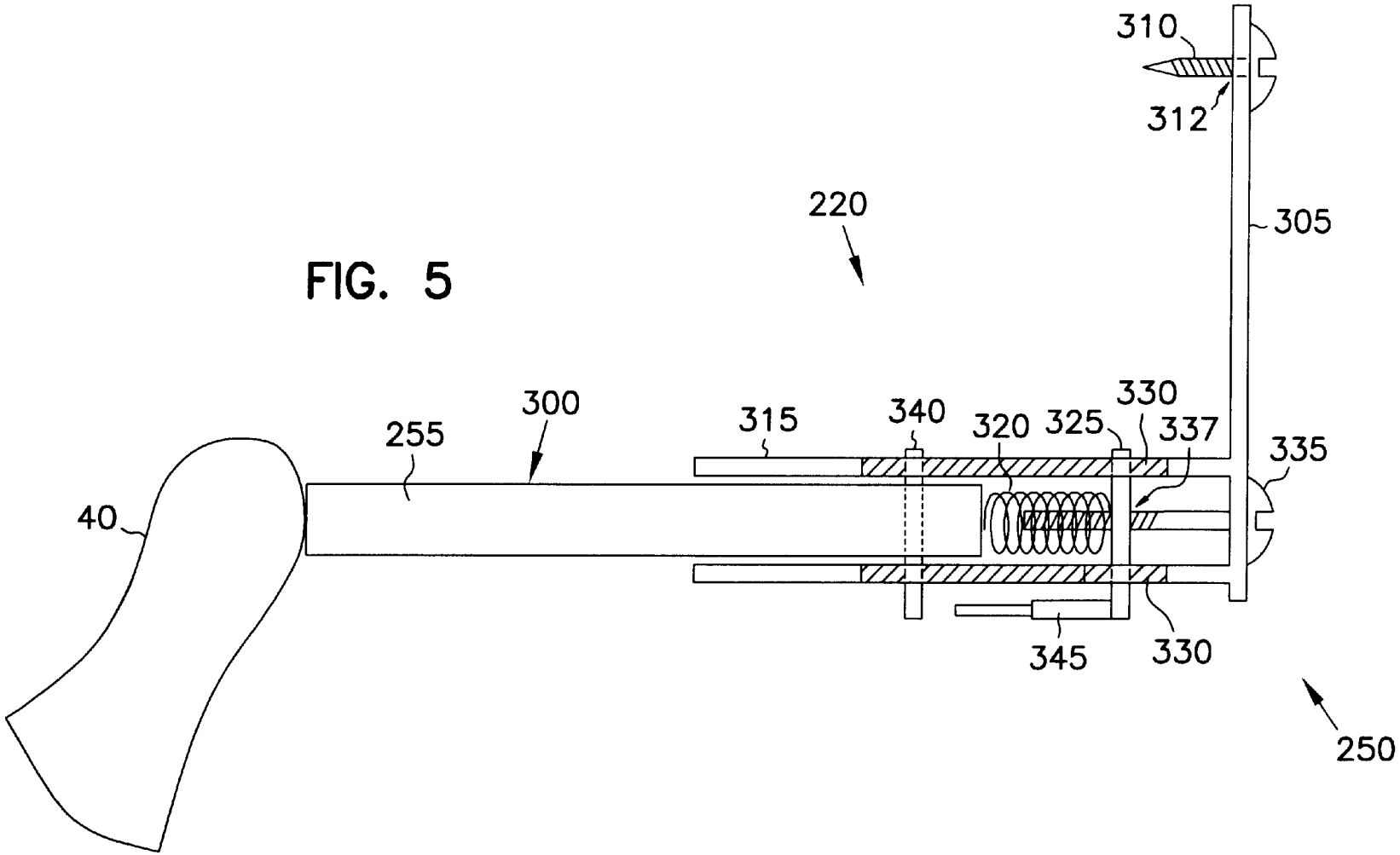
FIG. 5 is a schematic diagram, similar to FIG. 3, in which an adjustable-length spacer is provided.

In another example, a telescoping spacer 345 is provided, as illustrated in FIG. 5, such as for adjusting the length of spacer 345 prior to or even during implantation. Such a telescoping spacer 345 includes a locking feature (e.g., a set screw) to maintain the length of spacer 345 after it is adjusted to have a selected length and provide a calibrated force. Other techniques of implementing an adjustable-length spacer 345 can also be used to vary the amount of the calibrated force delivered to the auditory element according to the teachings of the present invention.

Figure 6:
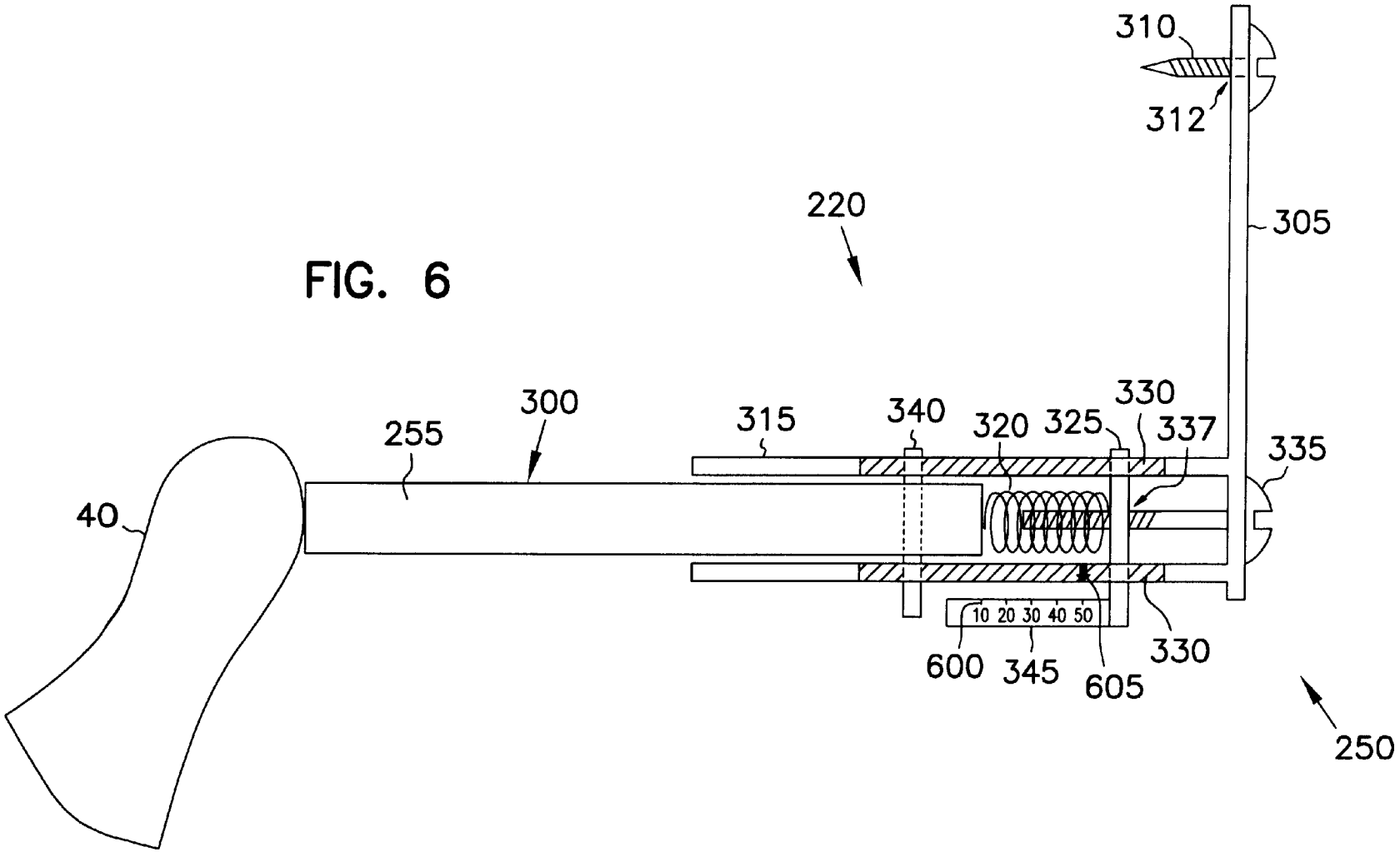
FIG. 6 is a schematic diagram, similar to FIG. 3, in which demarcations indicated the force provided by the deformable coupler.

In another embodiment, demarcations 600 are provided, as illustrated in FIG. 6. Demarcations 600 visually communicate to the implanting physician the degree of compression of spring 320. In one example, the demarcations 600 indicate units of force, and are provided on one of barrel 315 and spacer 345. The implanting physician can align the demarcations 600 with a physical feature or other alignment indicator 605 on the other of barrel 315 and spacer 345 by turning screw 335. The demarcations 600 provide a scale for selecting a desired force and a corresponding degree of compression of spring 320. FIG. 6 illustrates one embodiment in which an obtainable range of forces, as indicated by demarcations 600, is between 0 and 50 milli-Newtons (mN). In another example, demarcations 600 indicate an obtainable range of forces between 0–75 mN. Other obtainable ranges of forces may also be indicated by demarcations 600.

Figures 7, 8:
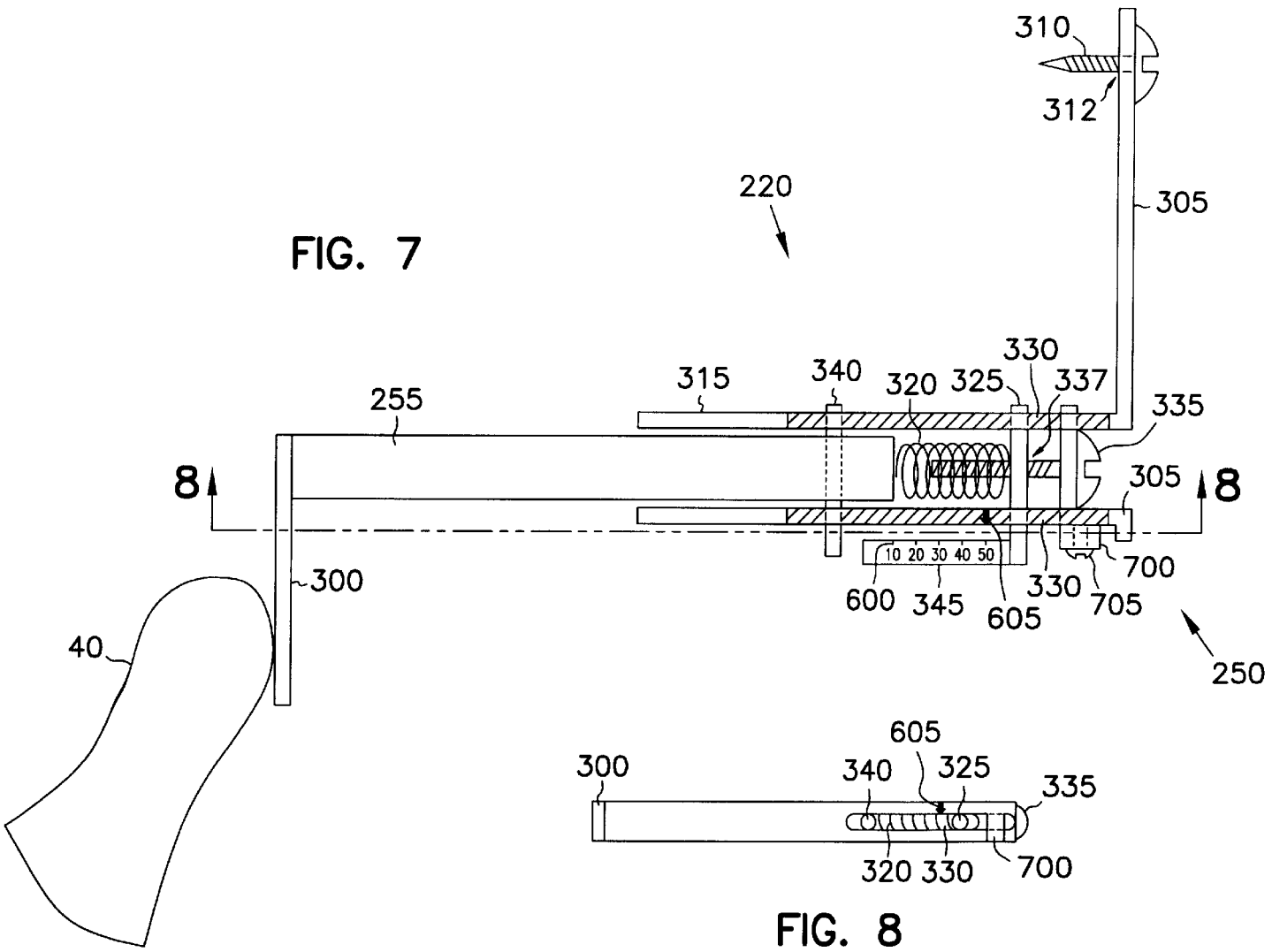
FIG. 7 is a schematic diagram, similar to FIG. 3, in which a receptacle provides adjustable positioning of a threaded member.
FIG. 8 illustrates generally a side view taken along the cutline 8—8 in FIG. 7.

FIG. 7 is a schematic diagram illustrating generally by way of example, but not by way of limitation, a cutaway view of another embodiment of a transducer mount 220 according to one aspect of the present invention. FIG. 7 is similar to FIG. 6 and FIG. 3, with the main differences being that in FIG. 7, first member 250 includes an opening in mounting portion 305 for accessing the coaxially hollowed interior of barrel 315. Screw 335 is captured by receptacle 700. Receptacle 700 extends through at least one slot of guide 330, allowing receptacle 700 to move along guide 330 in barrel 315 toward and away from mounting portion 305 of first member 250. Receptacle 700 is capable of being secured in position with respect to barrel 315, by a fastener such as set screw 705 or any other suitable technique. FIG. 8 illustrates generally a side view taken along the cutline 8—8 in FIG. 7.

For example, in one method of using this embodiment of the present invention, transducer mount 220 is implanted in middle ear 35 and mounting portion 305 is secured to mastoid 80. The physician adjusts the position of receptacle 700 in the slotted guide 330 until transducer 300 contacts the auditory element. Then, the physician secures receptacle 700 in position with respect to barrel 315 by tightening set screw 705. By turning screw 335, the physician adjusts the degree of compression of spring 320 as first stop 325 moves coaxially within barrel 315. As alignment indicator 605 moves past demarcations 600, the physician is able to monitor the degree of compression of spring 320 and degree of force applied to the auditory element.

Figure 9:
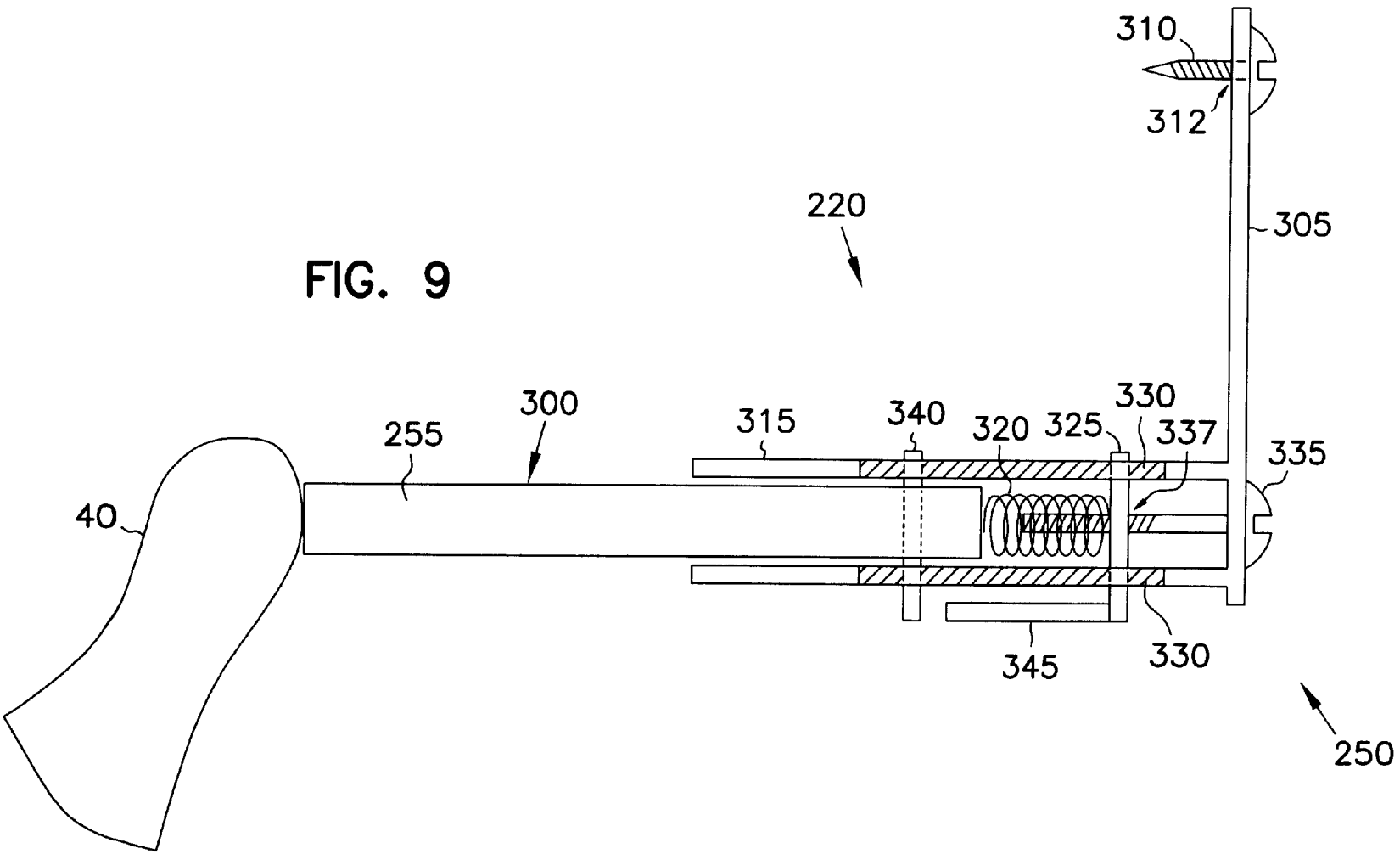
FIG. 9 illustrates generally a schematic diagram, similar to FIG. 3, in which the second member includes a longitudinally vibrating transducer.

FIG. 9 is a schematic diagram illustrating generally by way of example, but not by way of limitation, a cutaway view of another embodiment of a transducer mount 220 according to one aspect of the present invention. FIG. 9 is similar to FIG. 6, with one difference being that the transducer 300 is not cantilevered in FIG. 9. In FIG. 9, for example, transducer mount 220 provides contact between an auditory element (e.g., malleus 40) and a transducer 300 that is integrally formed as or with second member 255, rather than being cantilevered from second member 255. In one embodiment, transducer 300 is a piezoelectric ceramic or other transducer capable of longitudinal vibratory displacement in the direction that barrel 315 extends from mounting portion 305 of first member 250.

An alternative method of providing a controllable force is now described with respect to FIG. 9, but is understood to apply similarly to the other embodiments as well. In one embodiment, the degree of force applied to the auditory element is related to the number of turns, or fractional portions of turns, of screw 335. The relationship between the number of turns of screw 335 and the degree of compression of spring 320 is known, and this information is provided to the implanting physician.

In this embodiment, screw 335 is first turned until transducer 300 contacts the auditory element. Then, screw 335 is further turned by a desired amount in order to obtain the desired degree of compression of spring 320 and the resulting desired force between transducer 300 and the corresponding auditory element. For example, but not by way of limitation, one embodiment provides 50 milli-Newtons per turn. After screw 335 is turned such that the distance between transducer 300 and the corresponding auditory element (e.g., malleus 40) becomes infinitesimally small, a further ½ turn of screw 335 results in an applied force of 25 milli-Newtons. During manufacturing, adjusting the distance between threads of screw 335 and the spring constant of spring 320, separately or in combination, obtains other desired values of applied force per turn.

Figure 10:
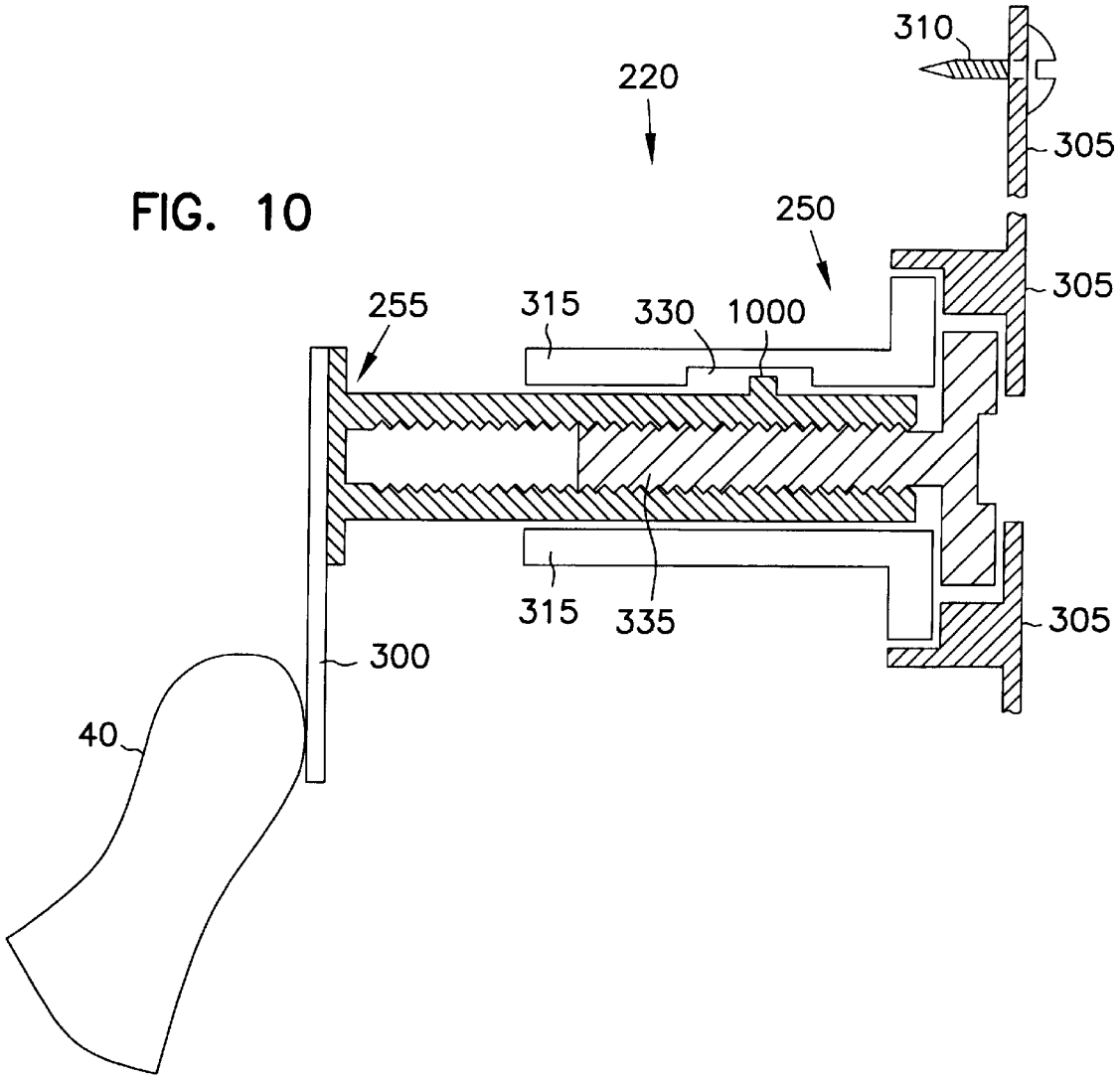
FIG. 10 is a schematic diagram illustrating generally a cutaway view of another embodiment of the transducer mount according to another aspect of the present invention.

FIG. 10 is a schematic diagram illustrating generally by way of example, but not by way of limitation, a cutaway view of another embodiment of a transducer mount 220 according to one aspect of the present invention in which spring 320 is omitted. In FIG. 10, transducer mount 220 includes first member 250 and second member 255. First member 250 provides an assembly that includes mounting portion 305, an engaging portion such as barrel 315, and a threaded member such as screw 335. In this embodiment, barrel 315 and mounting portion 305 are secured to each other with biocompatible adhesive therebetween, thereby capturing head portion of screw 335 and allowing the threaded portion of screw 335 to extend coaxially into barrel 315. However, screw 335 is free to rotate within barrel 315.

Second member 255 is received coaxially within barrel 315. Second member 255 is coaxially hollowed and threaded for receiving screw 335, thereby interposing second member 255 between barrel 315 and the threaded portion of screw 335. In one embodiment, slotted guide 330 extends at least partially through the interior portion of barrel 315 for receiving spring pin 1000. In this embodiment, spring pin 1000 and guide 330 are engaged, for limiting or preventing the rotation of second member 255 with respect to barrel 315, such as while turning screw 335, and for limiting travel of second member 255 to prevent dissociation of second member 255 from barrel 315 of first member 250.

Transducer mount 220 of FIG. 10 provides threadably engaged first and second members 250 and 255, respectively, such that the position of transducer 300 carried by second member 255 can be accurately adjusted with respect to the auditory element (e.g., malleus 40), even when mounting portion 305 is secured to mastoid 80, such as by screw 310. Screw 335, or other such threaded member, provides reliable and accurate positioning of transducer 300. In one embodiment, the distance between threads of screw 335 are selected for a known desired positional change in transducer 300 per turn of screw 335, thereby easing the delicate task of positioning transducer 300.

Figure 11:
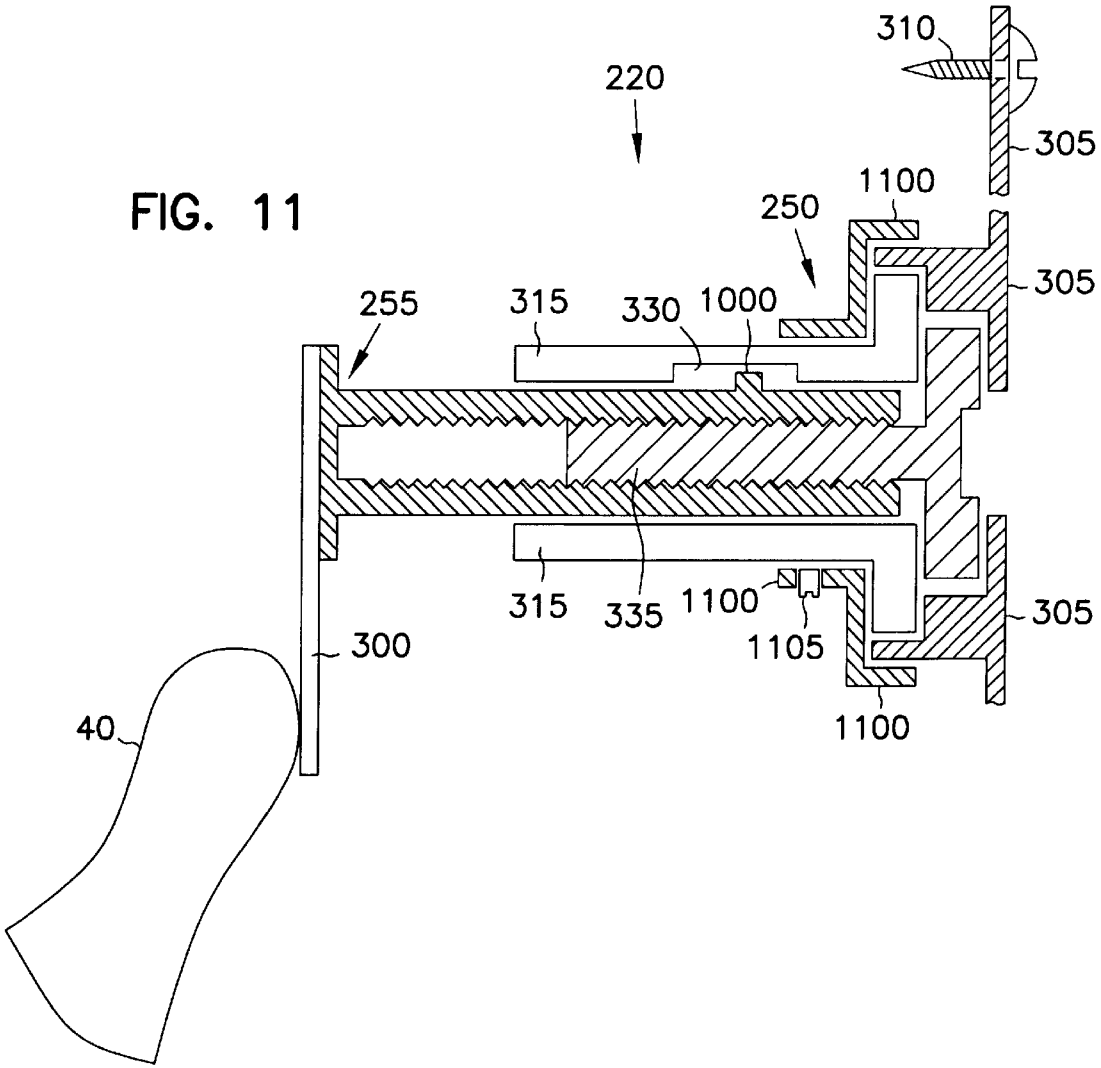
FIG. 11 illustrates generally a schematic diagram, similar to FIG. 10, further including a retainer member and a fastener.

FIG. 11 is a schematic diagram illustrating generally by way of example, but not by way of limitation, a cutaway view of another embodiment of a transducer mount 220. FIG. 11 is similar to FIG. 10, with one difference being that FIG. 11 includes a retainer 1100 member, rather than an adhesive, for holding together barrel 315 and mounting portion 305. Retainer 1100 is secured to mounting portion 305 adhesively, mechanically, or otherwise, such that barrel 315 is allowed to rotate until being secured in place by set screw 1105. This arrangement advantageously allows rotational adjustment of transducer 300, together with second member 255 and barrel 315, before or after mounting portion 305 is secured to mastoid 80. This further eases the delicate task of positioning transducer 300. As described above, longitudinal positional adjustment of transducer 300 is accommodated by turning screw 335.

Transducer mount 220 includes components (e.g., first member 250, second member 255, screws 310 and 335, etc.) that are formed from a biocompatible material such as, for example, polycarbonate, polypropylene, stainless steel, silicone, or titanium, which is shaped according to conventional injection molding and metal machining processes. The components of transducer mount 220, including first and second members 250 and 255, respectively, are proportioned for disposition within the middle ear. Screws 310 and 335 can be captured (i.e., prevented from dissociation) by first member 250, for example using the techniques described above with respect to FIG. 10, or other suitable techniques known in the art.

Force and Position for Sensing Malleus Vibrations

Experiments were conducted to determine the optimal force between transducer 300 and malleus 40 for sensing mechanical sound vibrations of malleus 40. Six human temporal bones from 3 subjects were harvested within 24 hours of death and stored at 4 degrees Celsius for a maximum of 6 days prior to use. Tympanometry confirmed the tympanic membrane 30 to be intact. All bones were maintained under moist conditions during the experiment, and no thawing or freezing occurred.

The bones were secured in a temporal bone holder and a complete mastoidectomy with atticotomy performed, allowing full exposure of the head portion of malleus 40. Incus 45 was removed but the ossicular chain 37 was not otherwise disrupted. A non-veined 1 millimeter by 7 millimeter lead zirconate titanate (PZT) piezoelectric bimorph transducer 300 (manufactured by Apollo Research, Depew, N.Y.) was fixed to a stainless steel bracket using cyanoacrylate, and the bracket was screwed to a load cell for measuring force and fixed to a micromanipulator. The system was zeroed and then transducer 300 was placed under varying conditions of bias force and position on the head of malleus 40.

Sound was delivered to tympanic membrane 30 by an earphone calibrated to provide 100 decibels (dB) sound pressure level (SPL) at 200 millivolts peak-to-peak. A 1 Volt root-mean-square (rms) sine wave stimulus, swept between 300 Hz and 3000 Hz, was provided to the earphone and also to a spectrum analyzer. The electrical input signal generated by transducer 300 was fed to the spectrum analyzer through an amplifier, and the transfer function (e.g., output signal of transducer 300 divided by the input signal provided to the earphone) was plotted.

The typical sensitivity obtained from the transducer 300 was 25 millivolts at 100 dB SPL in the external auditory canal 20. This varied minimally among the different positions on the malleus head. No particular position on the head of malleus 40 was consistently better across all the specimens, however, individual specimens gave the strongest signal at particular positions. This suggests that it is particularly important for transducer mount 220 to provide accurate positioning of transducer 300 when used for sensing vibrations of malleus 40.

At a frequency of 1000 Hz, a mean signal obtained from transducer 300 was 2.8 dB, with data ranging between −7 dB to +7 dB. This compares very favorably with a previous experiment (in which applied force was not quantified) obtaining only −13 dB at 1000 Hz (after scaling for comparison purposes), which is described in an article by K. Gyo et al., "Sound Pickup Utilizing an Implantable Piezoelectric Ceramic Bimorph Element: Application to the Cochlear Implant," Am. J. Of Otology, Volume 5, Number 4, pp. 273–276. A portion of this difference, however, may be accounted for by a differing transducer sensitivity used by Gyo et al.

Maximum signal strength was obtained with an applied force of approximately between 20 milli-Newtons and 50 milli-Newtons. Although signal strength dropped slightly when the applied force exceeded 50 milli-Newtons, the frequency response deteriorated markedly. Thus, varying the applied force between transducer 300 and malleus 40 significantly alters the electrical signal amplitude and frequency response of transducer 300, particularly at low frequencies. The experiment suggests that it is particularly advantageous for transducer mount 220 to provide a controllable, adjustable, or calibrated force that is approximately between 0 milli-Newtons and 75 milli-Newtons, or approximately between 0 milli-Newtons and 50 milli-Newtons, and preferably between 20 milli-Newtons and 50 milli-Newtons. However, flatter frequency responses were obtained for larger applied forces. Thus, it may also be advantageous to provide a controllable, adjustable, or calibrated force that exceeds 75 milli-Newtons. In one embodiment, adhesive affixation between transducer 300 and malleus 40 is used to obtain an extremely small force therebetween that approaches approximately 0 milli-Newtons.

Conclusion

The present invention provides an improved hearing assistance system that includes a device and method of providing more precise positioning and contact between a vibrating auditory element and a transducer that senses or provides such mechanical vibrations. According to one aspect of the present invention, adjustably positionable contact between a transducer and a corresponding auditory element is at a controllable, adjustable, or calibrated force. Adjusting a spatial relationship between first and second members of the transducer mount obtains the desired coupling force between the transducer and the auditory element. The adjustable coupling force is provided by compression of an elastically deformable coupler, such as a spring, with additional force obtained through a spacer member that limits further compression of the spring or other elastically deformable coupler. A calibrated coupling force is obtained by adjusting the spacing between the first and second members until just before the spacing between the first and second members is limited by the spacer, such that the elastically deformable coupler is compressed by an amount that is predetermined by the length of the spacer. For example, optimal force ranges for malleus vibration sensing are disclosed. According to another aspect of the invention, a precise adjustable positioning of the transducer is controllably obtained by turning a threaded member that threadably couples the first and second members of the transducer mount.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A transducer mount comprising:

a first member, proportioned for disposition in a middle ear;

a second member, proportioned for disposition in the middle ear, and movably engaging the first member; and an elastically deformable coupler, coupled to each of the first and second members.

2. The transducer mount of claim 1, wherein the deformable coupler includes a spring.

3. The transducer mount of claim 2, wherein the spring includes a material selected from the group consisting essentially of stainless steel or silicone.

4. The transducer mount of claim 2, wherein the spring has a spring constant of approximately 250 milli-Newtons per millimeter.

5. The transducer mount of claim 2, wherein the spring is configured for providing a compressive force that is approximately between 0 and 75 milli-Newtons.

6. The transducer mount of claim 5, wherein the spring is configured for providing a compressive force that is approximately between 20 and 50 milli-Newtons.

7. The transducer mount of claim 1, wherein the second member includes a transducer.

8. The transducer mount of claim 1, further comprising a first stop, engaging the first member and the deformable coupler.

9. The transducer mount of claim 8, wherein the first stop is adjustably spaced from at least a portion of the first member.

10. The transducer mount of claim 9, further comprising a threaded member adjustably spacing the first stop from the first member.

11. The transducer mount of claim 10, wherein a spacing between adjacent threads of the threaded member is such that a desired force is obtained from compressing the deformable coupler by rotating the threaded member.

12. The transducer mount of claim 10, further comprising a receptacle, engaging the threaded member and movably engaging the first member.

13. The transducer mount of claim 12, further comprising a fastener securing the receptacle to the first member.

14. The transducer mount of claim 8, further comprising a second stop, coupled to the second member and the deformable coupler.

15. The transducer mount of claim 14, further comprising a spacer, coupled to at least one of the first and second stops, wherein the first and second stops have a spatial relationship therebetween that is limited by the spacer.

16. The transducer mount of claim 15, wherein the spacer length is adjustable.

17. The transducer mount of claim 15, wherein the spacer includes features spaced at predetermined intervals for trimming away portions of the spacer between the depressions.

18. The transducer mount of claim 1, further including demarcations indicating a force provided by the deformable coupler.

19. The transducer mount of claim 1, further comprising a fastener coupled to the first member.

20. An apparatus comprising:

a first member, proportioned for disposition in a middle ear;

a second member, proportioned for disposition in the middle ear, and threadably engaging the first member; and a transducer, proportioned for disposition in the middle ear, and attached to the second member.

21. The apparatus of claim 20, in which the first member comprises:

a mounting portion;

an engaging portion; and a threaded member, a portion of the threaded member captured between the mounting portion and the engaging portion.

22. The apparatus of claim 21, in which the first member further comprises:

a retainer member, attached to the mounting portion and capturing at least part of the engaging portion between the retainer member and the mounting portion; and a fastener is configured for securing the engaging portion to the retainer member.

23. The apparatus of claim 21, in which the second member is coaxially hollowed and threaded for receiving the threaded member.

24. The apparatus of claim 23, in which the engaging portion of the first member includes a guide, and the second member includes a pin engaging the guide.

25. A hearing assistance system, comprising:

a transducer proportioned for coupling to an auditory element in a middle ear;

an electronics unit communicatively coupled to the transducer; and a transducer mount coupled to the transducer and proportioned for securing within the middle ear, the transducer mount including:

a first member, proportioned for disposition in a middle ear;

a second member, proportioned for disposition in the middle ear, and movably engaging the first member; and an elastically deformable coupler, coupled to each of the first and second members.

26. A hearing assistance system, comprising:

a transducer proportioned for coupling to an auditory element in a middle ear;

an electronics unit communicatively coupled to the transducer; and a transducer mount coupled to the transducer and proportioned for securing within the middle ear, the transducer mount including:

a first member, proportioned for disposition in a middle ear; and a second member, proportioned for disposition in the middle ear, and threadably engaging the first member, and carrying the transducer.

27. A method of sensing mechanical vibrations of a malleus, the method comprising:

disposing a piezoelectric transducer in the middle ear;

positioning a portion of the transducer to contact the malleus; and adjusting a force between the transducer and the malleus to be approximately between 0 milli-Newtons and 75 milli-Newtons.

28. The method of claim 27, in which the force between the transducer and the malleus is adjusted to be approximately between 0 milli-Newtons and 50 milli-Newtons.

29. The method of claim 27, in which the force between the transducer and the malleus is adjusted to be approximately between 20 milli-Newtons and 50 milli-Newtons.

30. A method of coupling a transducer to an auditory element, the method comprising:

disposing a transducer mount in a middle ear, the transducer mount including a first member and also including a second member carrying a transducer and movably engaged with the first member by an elastically deformable coupler; and coupling the transducer to an auditory element; and adjusting a spatial relationship between the first and second members to provide a desired coupling force between the transducer and the auditory element.

31. The method of claim 30, further comprising securing the transducer mount in the middle ear before coupling the transducer to the auditory element.

32. The method of claim 30, wherein adjusting a spatial relationship between the first and second members to provide the desired coupling force between the transducer and the auditory element includes compressing the elastically deformable coupler to obtain the desired coupling force.

33. The method of claim 30, wherein adjusting a spatial relationship between the first and second members to provide the desired coupling force between the transducer and the auditory element includes engaging the first and second members with a spacer whereby a spatial relationship between the first and second members is limited by the spacer to obtain the desired coupling force.

34. The method of claim 33, wherein engaging the first and second members limits the compression of the elastically deformable coupler.

35. A method of coupling a transducer to an auditory element, the method comprising:

disposing a transducer mount in a middle ear, the transducer mount including a first member and also including a second member carrying a transducer, and wherein the first member includes a threaded member that is threadably engaged with the second member; and coupling the transducer to the auditory element by turning the threaded member to adjust a spatial relationship between the first and second members.

* * * * *